US010890397B2

(12) United States Patent
Findlay et al.

(10) Patent No.: US 10,890,397 B2
(45) Date of Patent: Jan. 12, 2021

(54) APPARATUS TO MINIMIZE SHORT STROKE IN A REVOLVER

(71) Applicant: Kimber IP, LLC, Yonkers, NY (US)

(72) Inventors: David Scott Findlay, Troy, AL (US); Michael Villa, Maspeth, NY (US); Ronald Richard Dudzic, Jr., Tarrytown, NY (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 16/358,199

(22) Filed: Mar. 19, 2019

(65) Prior Publication Data

US 2020/0300571 A1 Sep. 24, 2020

(51) Int. Cl.
*F41A 19/51* (2006.01)
*F41C 3/14* (2006.01)

(52) U.S. Cl.
CPC ..... *F41A 19/51* (2013.01); *F41C 3/14* (2013.01)

(58) Field of Classification Search
CPC ..... F41A 19/51; F41C 3/14
See application file for complete search history.

(56) References Cited

U.S. PATENT DOCUMENTS 3,777,384 A * 12/1973 Ruger ..... F41A 17/74 42/66
4,391,057 A * 7/1983 Bornancini ..... F41A 19/53 42/65
4,437,250 A * 3/1984 Beretta ..... F41C 3/14 42/59
4,641,449 A * 2/1987 Kapland ..... F41C 3/14 42/65
4,766,687 A * 8/1988 Ruger ..... F41A 19/11 42/59
4,819,358 A * 4/1989 Eder ..... F41A 19/16 42/59
5,664,356 A * 9/1997 Pantuso ..... F41A 17/82 42/65
6,571,502 B1 6/2003 Mikuta
7,536,817 B2 5/2009 Storch
7,886,469 B2 * 2/2011 Curry ..... F41C 3/14 42/67
2005/0126062 A1 * 6/2005 Ghisoni ..... F41A 19/52 42/65
2009/0044437 A1 * 2/2009 Zajk ..... F41A 19/10 42/65

(Continued)

OTHER PUBLICATIONS

Authorized Officer: Harry C. Kim, International Search Report and Written Opinion issued in counterpart PCT application No. PCT/US2020/020792, dated Apr. 8, 2020, 6 pp.

*Primary Examiner* — Michelle Clement
(74) *Attorney, Agent, or Firm* — Kaplan Breyer Schwarz, LLP

(57) ABSTRACT

An apparatus to minimize short stroke in a revolver is provided wherein a first end of the transfer bar is pivotably disposed on the trigger adjacent to the first end of a hand, the second end of the transfer bar disposed adjacent to the firing pin of the hammer, wherein during a firing cycle, prior to the revolver being brought back to the ready-to-fire position, the trigger cannot be depressed until the trigger is first fully undepressed, wherein the second end of the transfer bar engages a transfer bar blocking surface of the hammer slot in the hammer to prevent the trigger from being fully depressed.

2 Claims, 14 Drawing Sheets

(56) References Cited

U.S. PATENT DOCUMENTS

| | | | | |
|---|---|---|---|---|
| 2014/0190053 | A1* | 7/2014 | Zajk | F41C 3/14 42/65 |
| 2015/0047243 | A1* | 2/2015 | Tusting | F41A 19/52 42/66 |
| 2015/0338177 | A1* | 11/2015 | Assis | F41C 3/14 42/62 |

* cited by examiner

APPARATUS TO MINIMIZE SHORT STROKE IN A REVOLVER

BACKGROUND OF THE INVENTION

The present invention is directed to firearms. More particularly, the present invention is directed to revolvers and the quality control issue known as short stroke.

In revolver production and assembly, a condition known as "short stroke" may occur, as is known in the art. Some revolver manufacturers adjust their revolvers during assembly so that the timing of the gun does not allow the trigger to be pulled to rotate the cylinder until the gun is capable of being fired. The present design is directed to resolve the issue of short stroke and eliminate the added steps typically required during manufacturing to minimize revolver short stroke.

As can be seen in FIG. 1 and in the detail views of FIGS. 2-7, in prior revolvers 10, a test may be made to determine if a revolver has a short stroke issue. The basic elements of the prior art revolver 10 that are relevant to the present invention are a frame 12, a trigger 14, a cylinder 16, a bolt 18, a hammer 20, and a hand (not shown). For present purposes, a double action revolver is described, wherein depressing the trigger 14 by a user both cocks the hammer 20 and rotates the cylinder 16 to align the next breach chamber (not shown) with the revolver barrel. 16. It is noted that the present invention is not intended to be limited to just double action revolvers. The firing sequence of a typical prior art revolver 10 is essentially as follows: The trigger 14 is depressed to push the hammer 20 backward to cock the revolver 10. As the trigger 14 moves backwards, the hammer 20 compresses a spring (not shown). The hand pushes on a ratchet having teeth on the cylinder end 30 to rotate the cylinder 16 to position a new breach chamber adjacent to the barrel 34 of the revolver 10. The bolt 18 has a bolt pawl 36, rotationally disposed on the frame 12 adjacent to the trigger 14, and is positioned such that the bolt pawl 36 engages a corresponding depression 38 on the cylinder 16 (one for each breach chamber 32 in the cylinder 16) and stops the cylinder 16 in a position such that a breach chamber 32 is aligned with the barrel 34. When the trigger 14 is fully depressed by a user, the hammer 20 is released. The compressed spring urges the hammer 20 forward to discharge a cartridge in the breach chamber presently aligned with the barrel 34.

The sequence of events to test for short stroke is as follows. As shown in FIG. 2, the revolver 10 is in a ready-to-fire configuration with the bolt 18 in a cylinder depression 38 and a trigger pawl 40 is engaged in a receiving slot 42 in the bolt 18.

As can be seen in FIG. 3, as the trigger 14 is pulled (i.e., rotated in direction A), the trigger pawl 40 rotates downwardly (clockwise in the drawing) in the receiving slot 42 of the bolt 18 until a flat surface 44 of the trigger pawl 40 partially engages a tip 46 of the receiving slot 42 such that the bolt 18 rotates downwardly to disengage from the cylinder depression 38.

As can be seen in FIG. 4, as the trigger 14 is continued to be pulled (rotated in direction A), the flat surface 44 of the trigger pawl 40 completely disengages from the receiving slot 42, such that the bolt 18 now is urged upwardly (clockwise in direction B in the drawing) such that the bolt pawl 36 is engaged in a cylinder depression 38 to lock the cylinder 16 in place for firing of the revolver 10.

As can be seen in FIG. 5, the trigger 14 is now released such that it rotates to its forward position (counterclockwise in direction C in the drawing). The trigger pawl 40 rotates upwardly such that it engages the receiving slot 42 and pushes the bolt 18 upwardly to engage the bolt pawl 36 with the cylinder depression 38.

As can be seen in FIG. 6, as the trigger 14 rotates forward, the trigger pawl 40 moves upwardly (counterclockwise in direction D in the drawing) to a halfway position where the flat surface 44 of the trigger pawl 40 engages the tip 46 of the receiving slot 42. This is a position wherein a quality test may reveal whether short stroke may occur. The test involves attempting to pull the trigger 14 with the various elements described here in this configuration. The cantilever motion of the trigger pawl 40 attempts to pull the bolt 18 down (counterclockwise in this drawing). However, in this configuration, the hand has already reset to the next ratchet tooth on the cylinder 16, and the cylinder 16 rotates to its next position (aligning a new breach chamber with the barrel 34). But, since the hammer 20 has not fully reset, the revolver cannot fire. See FIG. 7. This is short stroke.

In the past, to ensure that short stroke cannot occur, typically various parts having different tolerances may be replaced, and pivot pins may be adjusted. It would be desirable to achieve the result of minimized short stroke through a design that provides for mechanical avoidance of short stroke.

Some patents that provide for mechanisms that accomplish similar results include the following:

U.S. Pat. No. 4,641,449 (Kapland el al.) discloses an anti-lock up mechanism for revolvers in which includes a cam follower lever cooperating with cam surfaces of the revolver hand for insuring that during manually controlled movement of the trigger following a manual hammer movement back to its battery position, the hand end will move into a position to engage the next ratchet tooth after the trigger has been engaged with its cylinder lock so that the trigger can be manually moved into its rearward position from any position to prevent the trigger being locked (as would be the case when the hand moves into position to engage the next ratchet tooth before the trigger has engage with the cylinder lock).

U.S. Pat. No. 7,536,817 (Storch) discloses a no-skip recocking revolver that prevents the cylinder from advancing upon being recocked should the revolver be uncocked without firing. A hand retainer is automatically or manually set by the shooter. When the retainer is set, it prevents the hand from engaging the cylinder ratchet and rotating the cylinder past a live round.

U.S. Pat. No. 6,571,502 (Mikuta) discloses an electronically fired revolver utilizing a latch mechanism between trigger and hammer to implement firing. The latch mechanism is pivotally attached to the frame and engages the hammer in a set position during actuation of the firing mechanism. The latch releases the hammer from the set position to displace the firing mechanism to the firing position to fire the revolver.

All references cited herein are incorporated herein by reference in their entireties.

BRIEF SUMMARY OF THE INVENTION

An apparatus to minimize short stroke in a revolver is provided. Pulling (i.e., depressing) of a trigger of the revolver activates a hammer of the revolver to fire the revolver. The revolver has a ready-to-fire position wherein the trigger is in a fully undepressed configuration. The revolver must be brought to the ready-to-fire position subsequent to each firing cycle of the revolver.

In a first exemplary embodiment of the present invention, the revolver includes a frame, a hammer rotationally mounted in the frame and having a firing pin. The hammer has a hammer slot therein with a transfer bar blocking surface. The revolver further includes a barrel, a trigger having a trigger pawl and a cylinder disposed in the frame. The cylinder has a plurality of breach chambers disposed about a central axis and has a ratchet having teeth. The cylinder to rotates about the central axis, and has a plurality of depressions, where each depression disposed adjacent to one of the breach chambers. The ratchet has teeth to index the cylinder in the frame to serially align one of the breach chambers with the barrel. The revolver further has a bolt pivotably disposed on the frame between the trigger and the cylinder. The bolt has a first end having a receiving slot for receiving the trigger pawl and a second end having a bolt pawl for engaging one of cylinder depressions. The revolver further has a hand having a first end disposed on the trigger, and a second end disposed against a tooth of the ratchet. Pulling of the trigger causes the hand to index the cylinder to align a new breach chamber with the barrel. In this initial embodiment, a transfer bar is provided having a first end and a second end. The first end of the transfer bar is pivotably disposed on the trigger adjacent to the first end of the hand. The second end of the transfer bar is disposed adjacent to the firing pin of the hammer. When the revolver is in the ready-to-fire position, the second end of the transfer bar is disposed away from the hammer and the breach chamber to prevent a cartridge from being fired. At firing, the second end of the transfer bar moves between the hammer and the breach chamber to provide for discharging of the revolver. During the firing cycle, prior to the revolver being brought back to the ready-to-fire position, the trigger cannot be depressed until the trigger is first fully undepressed, wherein the second end of the transfer bar engages the transfer bar blocking surface of the hammer slot in the hammer to prevent the trigger from being fully depressed.

The firing cycle of the revolver begins at the ready-to-fire configuration. The trigger is pulled, the bolt disengages from the depression, the hand engages the ratchet to turn the cylinder such that a new breach chamber is aligned with the barrel, the bolt engages a next depression in the cylinder, the hammer activates to discharge a cartridge in the breach chamber aligned with the barrel and simultaneously, the transfer bar raises such that its second end is disposed between the hammer and breach chamber to allow for firing. The trigger is released causing the various elements to move back to the ready-to-fire configuration, wherein the transfer bar moves to a down position away from the firing pin.

In a second additional or supplemental exemplary embodiment of the present invention, the device comprises the trigger pawl having a rounded nose such that the trigger cannot pull the bolt out of engagement and ensure that the bolt is always properly reset.

As a separate, standalone embodiment a device to minimize short stroke in a revolver, the revolver includes a frame, a barrel, a trigger having a trigger pawl, and a cylinder. The cylinder is disposed in the frame and has a plurality of breach chambers disposed about a central axis and has a ratchet having teeth. The cylinder is adapted to rotate about the central axis and has a plurality of depressions, each depression disposed adjacent to one of said breach chambers. The ratchet has teeth to index the cylinder in the frame to align one of the breach chambers with the barrel. A bolt is pivotably disposed on the frame between the trigger and the cylinder and has a first end having a receiving slot for receiving the trigger pawl and a second end having a bolt pawl for engaging one of the depressions. A hand is provided having a first end disposed on the trigger, and a second end disposed against a tooth of the ratchet. Pulling of the trigger causes the hand to index the cylinder to align a new breach chamber with the barrel. The trigger pawl has a rounded nose such that the trigger cannot pull the bolt out of engagement and ensure that the bolt is always properly reset to avoid short stroke.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiment, but it should be understood that the present invention is not deemed to be limited thereto.

Figure 1:
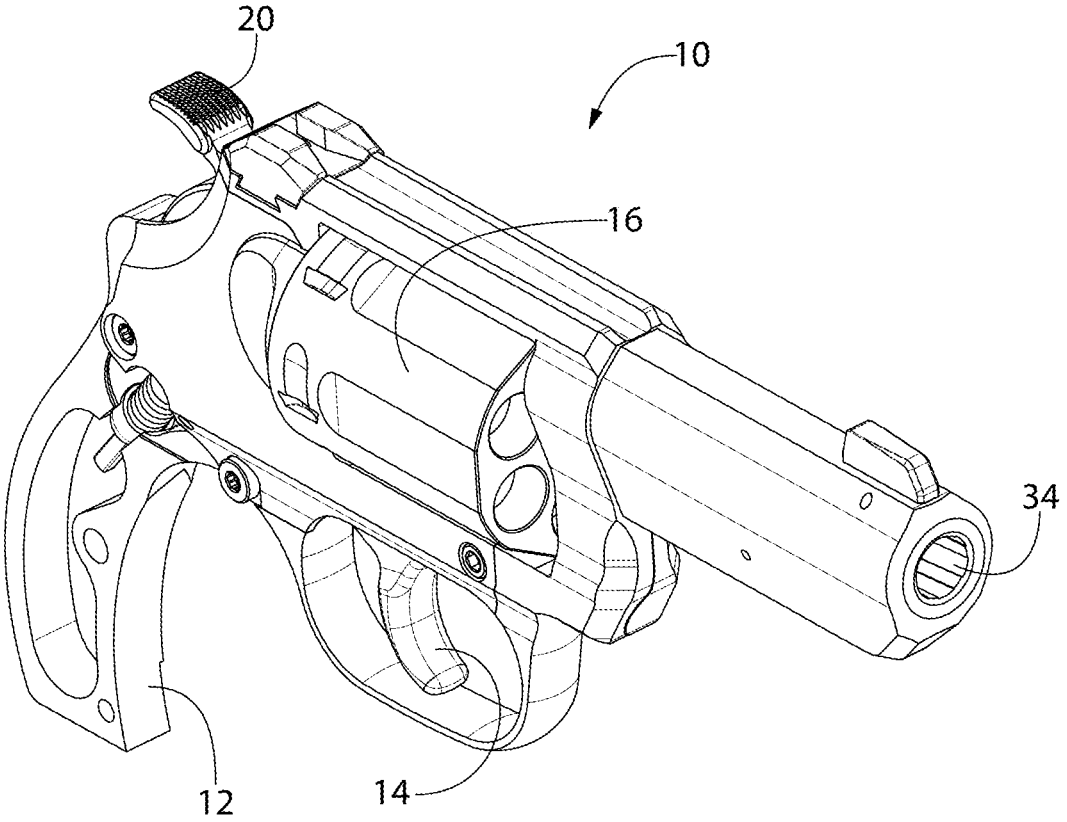
FIG. 1 (PRIOR ART)
FIG. 1 is an isometric view of a prior art revolver.
Figure 2:
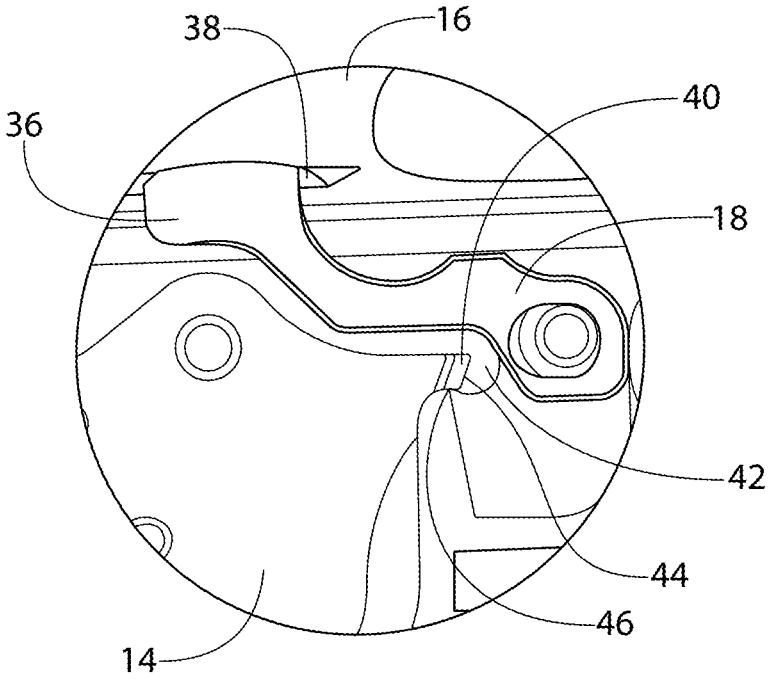
FIG. 2 (PRIOR ART)
FIG. 2 is a side elevation detail view of the trigger, cylinder and hand of the prior art revolver of FIG. 1, shown in a ready-to-fire configuration.
Figure 3:
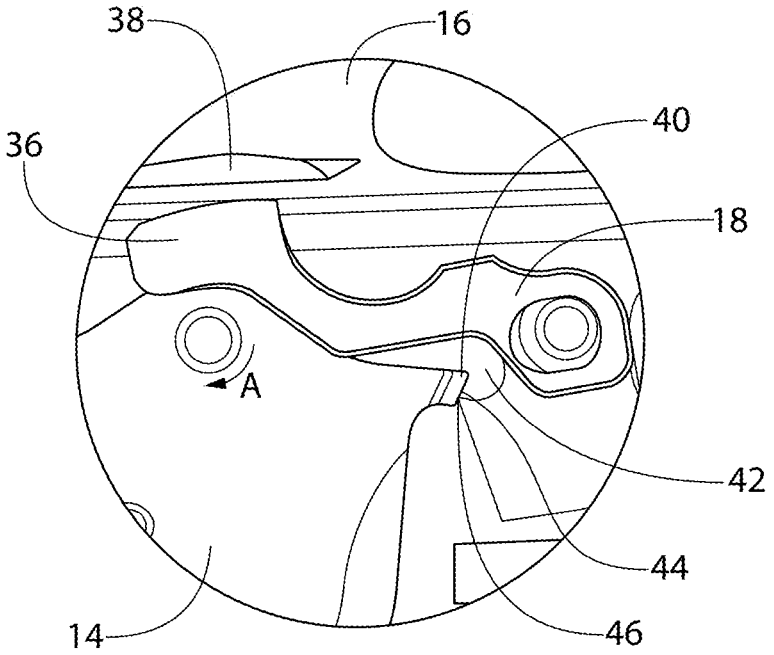
FIG. 3 (PRIOR ART)
FIG. 3 a side elevation detail view of the trigger, cylinder and hand of the prior art revolver of FIG. 1, shown with the trigger partially depressed during a firing cycle.
Figure 4:
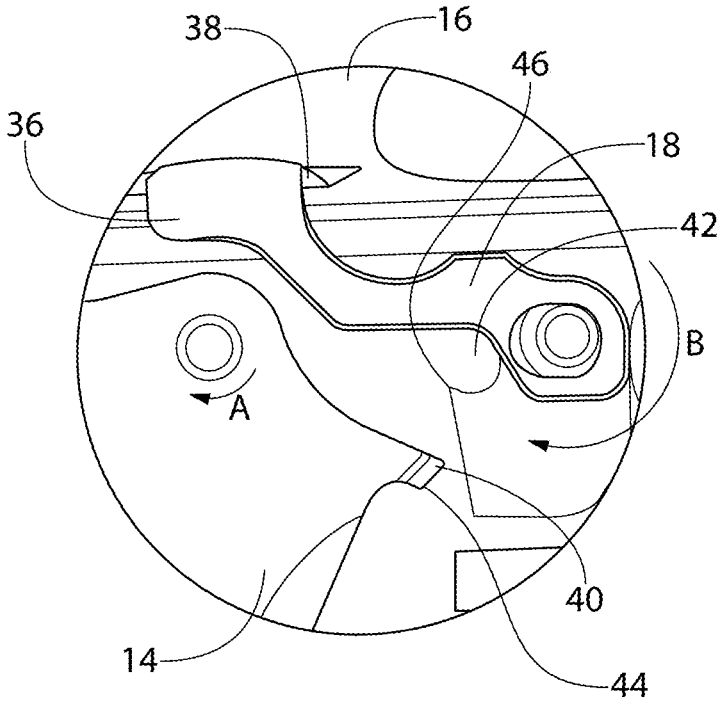
FIG. 4 (PRIOR ART)
FIG. 4 a side elevation detail view of the trigger, cylinder and hand of the prior art revolver of FIG. 1, shown with the trigger further depressed than that of FIG. 3 during a firing cycle.
Figure 5:
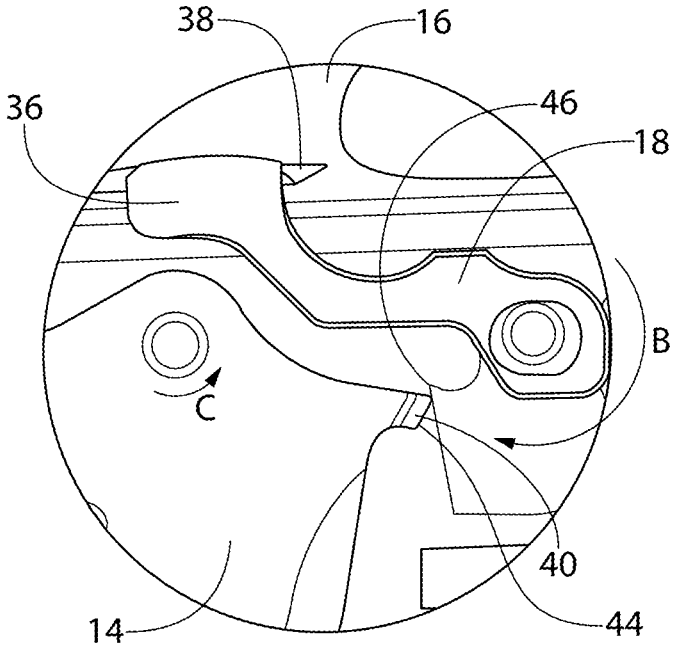
FIG. 5 (PRIOR ART)
FIG. 5 a side elevation detail view of the trigger, cylinder and hand of the prior art revolver of FIG. 1, shown with the trigger fully depressed during a firing cycle.
Figure 6:
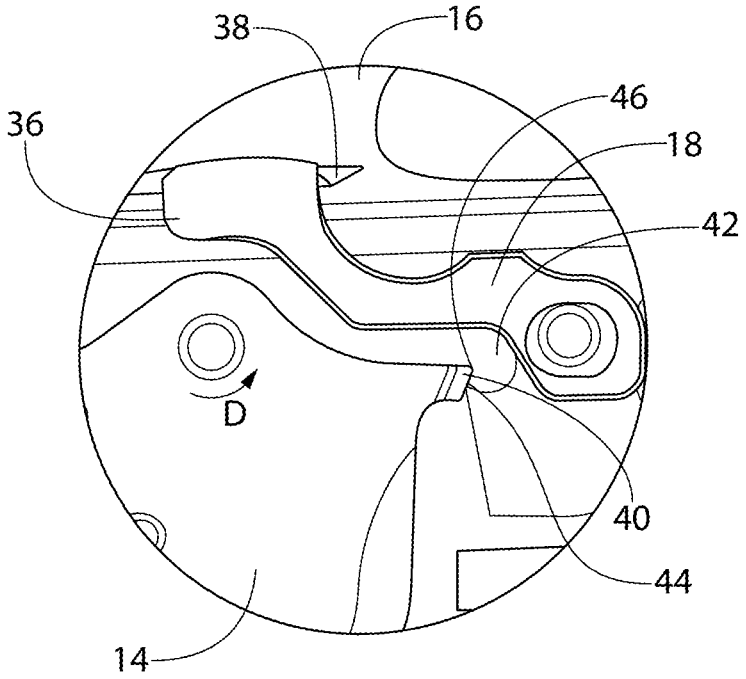
FIG. 6 (PRIOR ART)
FIG. 6 a side elevation detail view of the trigger, cylinder and hand of the prior art revolver of FIG. 1, shown with the trigger in an initial partially undepressed condition, after the firearm is discharged during a firing cycle, at a point where short stroke may occur.
Figure 7:
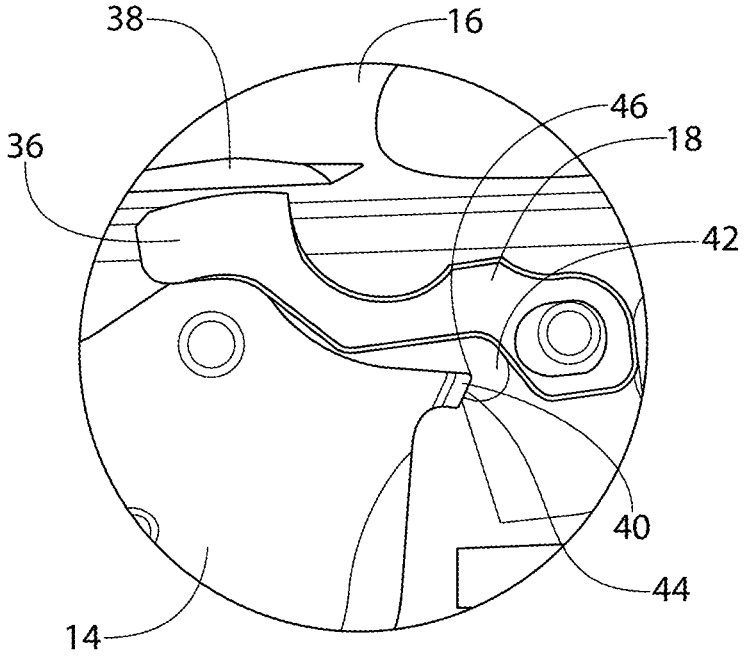
FIG. 7 (PRIOR ART)
FIG. 7 a side elevation detail view of the trigger, cylinder and hand of the prior art revolver of FIG. 1, shown with the trigger in a further partially undepressed condition, after the firearm is discharged during a firing cycle.
Figure 8:
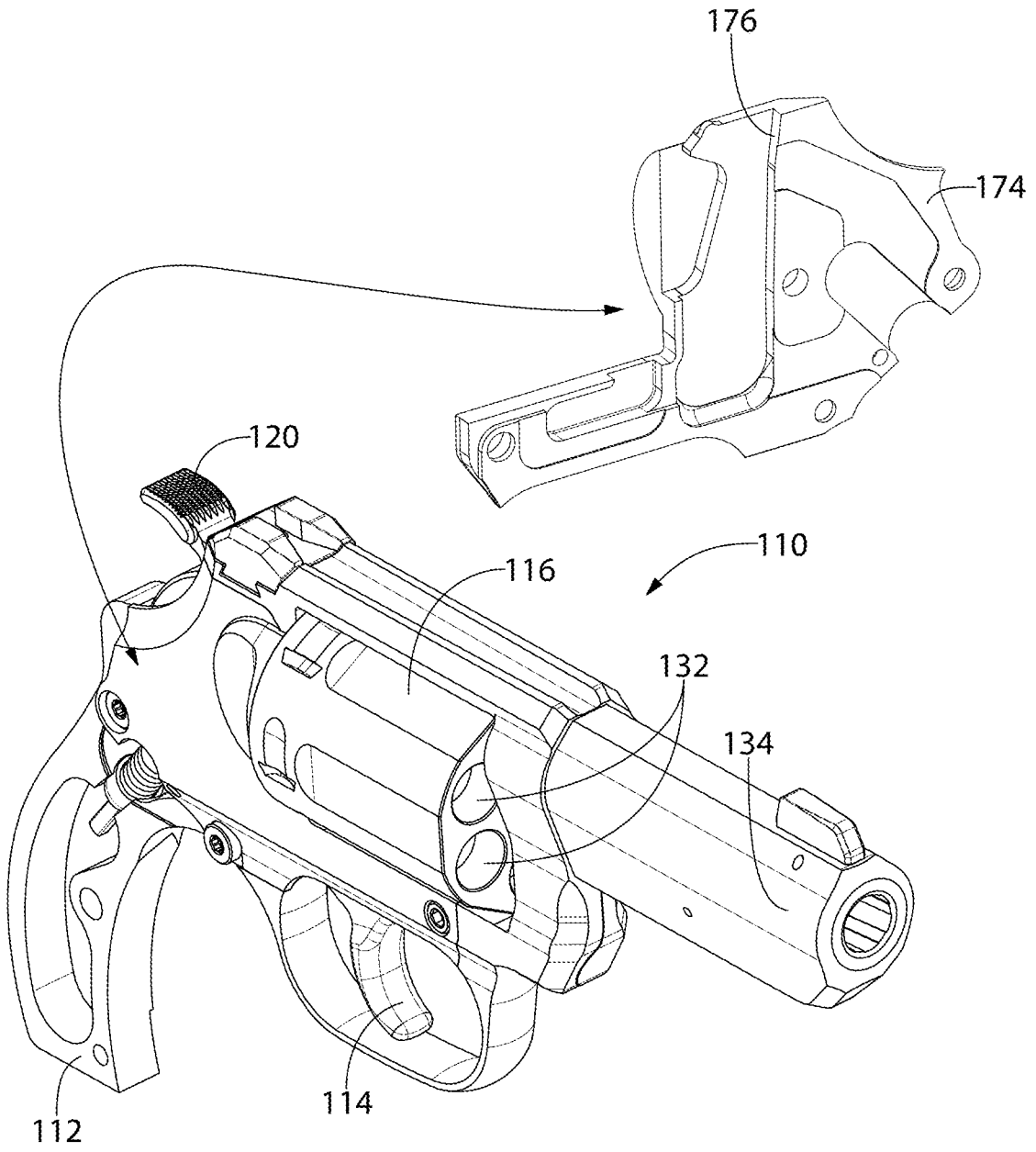
FIG. 8 is an isometric view of a revolver having an apparatus to minimize short stroke in the revolver in accordance with an exemplary embodiment of the present invention, supplemented with an isometric view of its sideplate internal surfaces.
Figure 9:
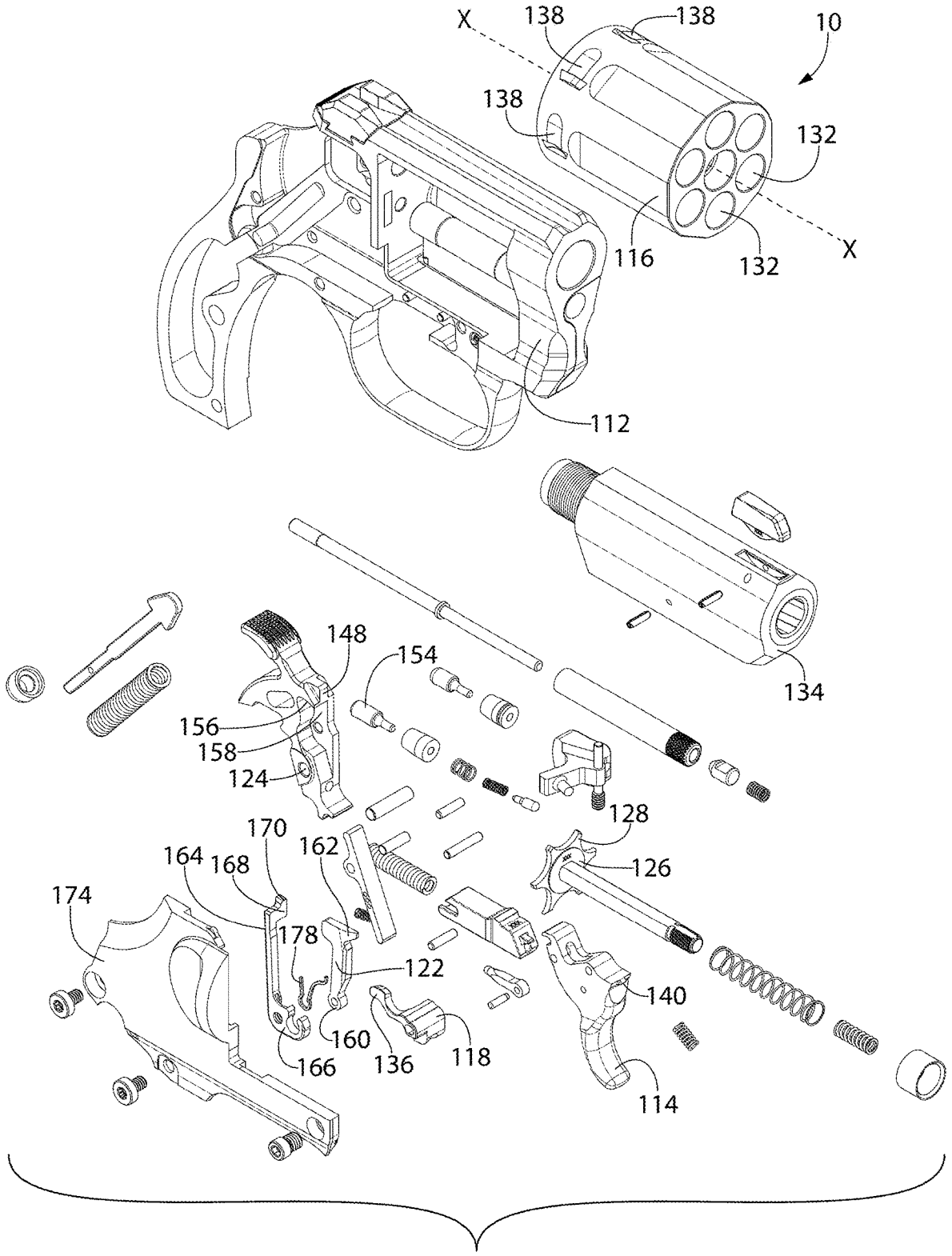
FIG. 9 is an exploded, isometric view of the apparatus to minimize short stroke in a revolver of FIG. 8.
Figure 10:
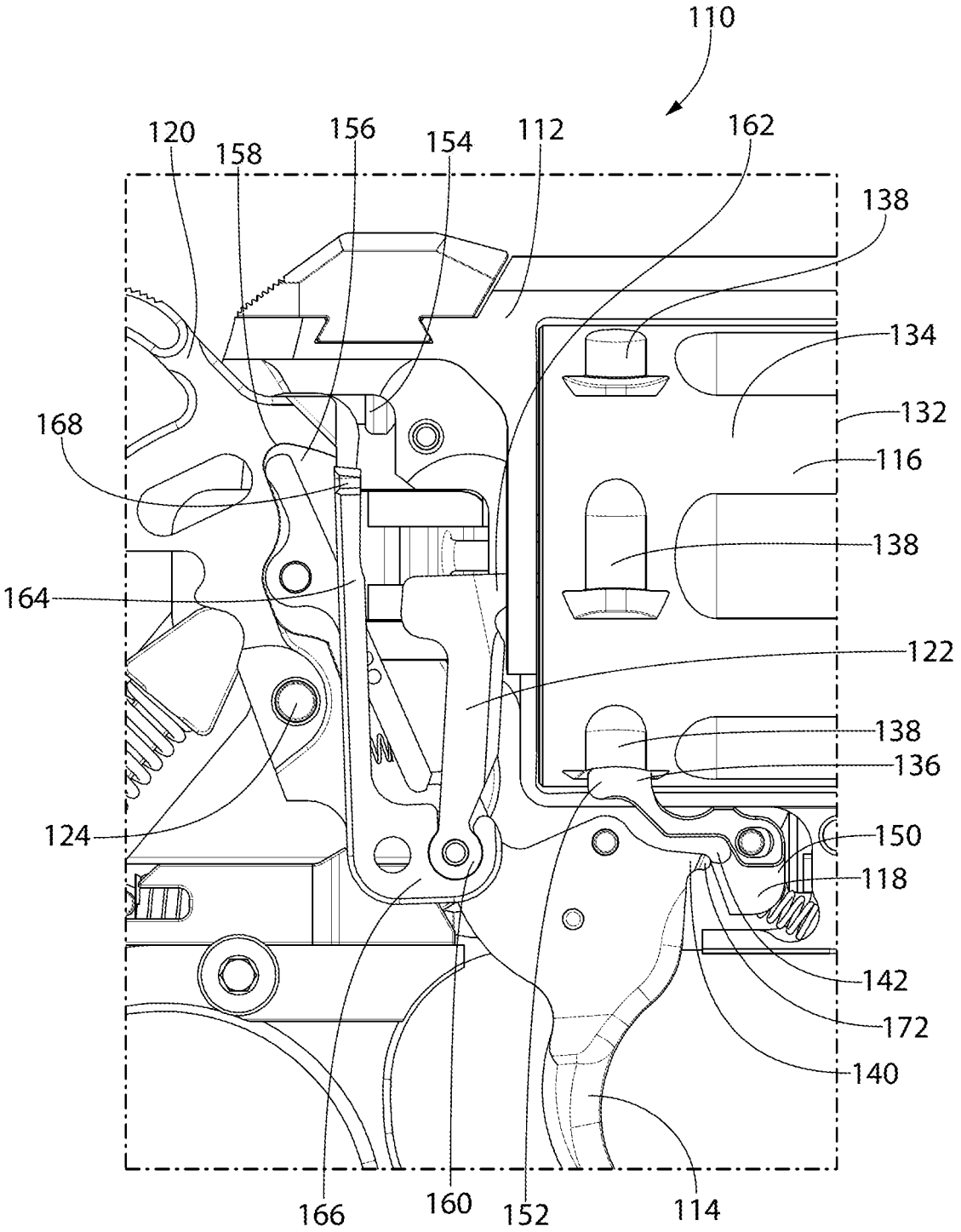
FIG. 10 is a partial right side elevation view of the apparatus to minimize short stroke in a revolver of FIG. 8.
Figure 11:
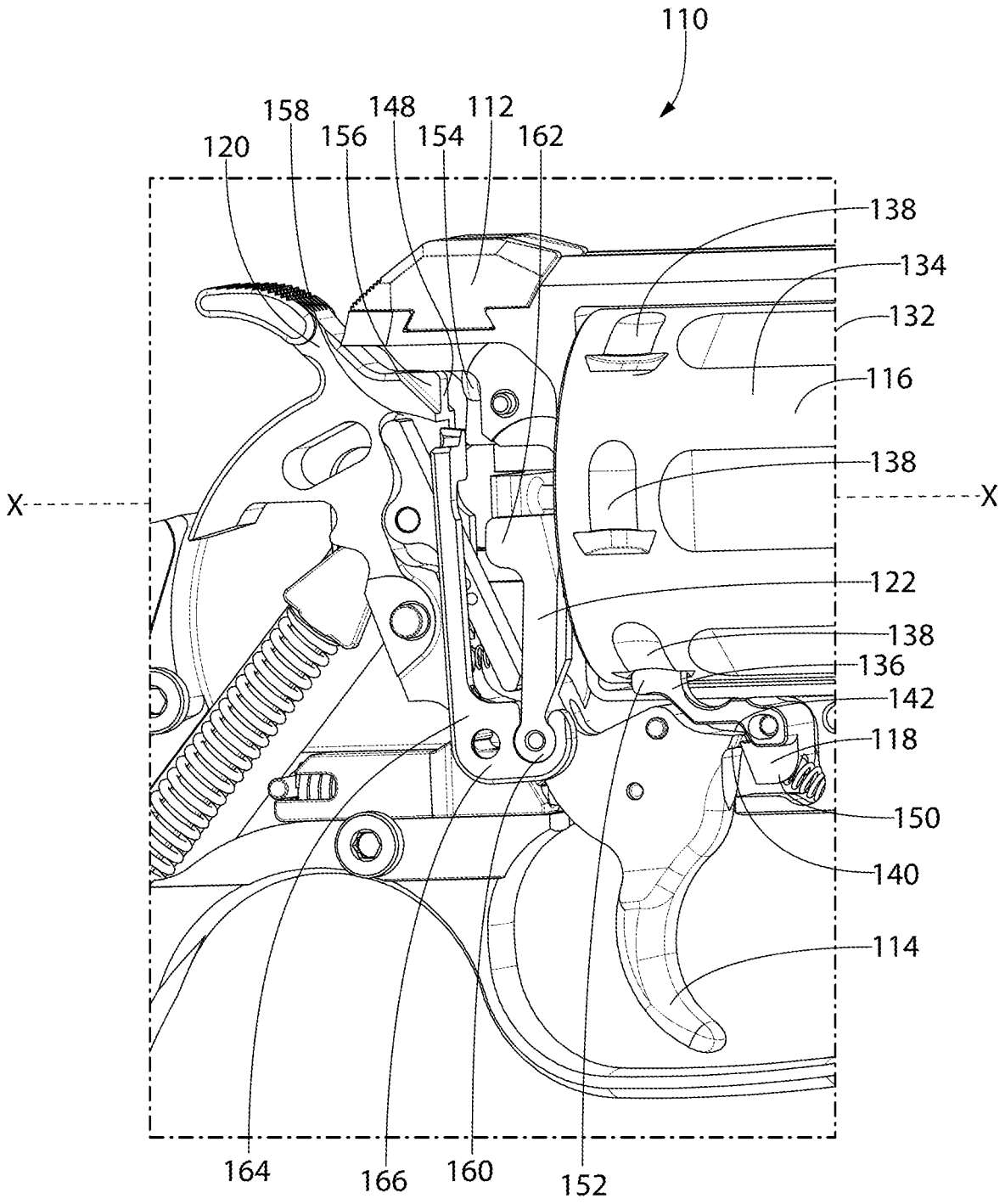
FIG. 11 is a partial, right side isometric detail view of the apparatus to minimize short stroke in a revolver of FIG. 8, in a ready-to-fire configuration.

Referring now to the drawing figures wherein like part numbers refer to like elements throughout the several views, there is shown in FIGS. 8-18 an apparatus to minimize short stroke in a revolver 110. The apparatus is directed to the revolver 110 wherein pulling of a trigger 114 of the revolver 110 initiates a firing cycle to activate a hammer 20 to fire the revolver 110. As seen in FIG. 10, as is typical for revolvers in general, the revolver 110 has a frame 112, a barrel 134, the trigger 114, a cylinder 116, a bolt 118 and a hand 122. The hammer 120 is rotationally mounted in the frame 112 about a pivot point 124 and has a hammer surface 148 for striking a firing pin 154 (via a transfer bar 164). The trigger 114 has a trigger pawl 140 to engage the bolt 118. The cylinder 116 is disposed in the frame 112 and has a plurality of breach chambers 132 disposed about a central axis X. The cylinder 116 further has a ratchet 126 having teeth 128 associated therewith, and is adapted to rotate about the central axis X. A plurality of depressions 138 are located radially on the cylinder 116, each disposed adjacent to one of the breach chambers 132. The teeth 128 of the ratchet 126 index the cylinder 116 in the frame 112 to align one of the breach chambers 132 with the barrel 134.

The bolt 118 is pivotably disposed on the frame 112 between the trigger 114 and the cylinder 116. The bolt 118 has a first end 150 having a receiving slot 142 for receiving the trigger pawl 140 and a second end 152 having a bolt pawl 136 for engaging one of the depressions 138 in the cylinder 116.

The hand 122 has a first end 160 disposed on the trigger 114, and a second end 162 disposed against one of the teeth 128 of the ratchet 126. Depressing the trigger 114 causes the hand 122 to index the cylinder 116 to align the next breach chamber 132 with the barrel 134.

Figure 12:
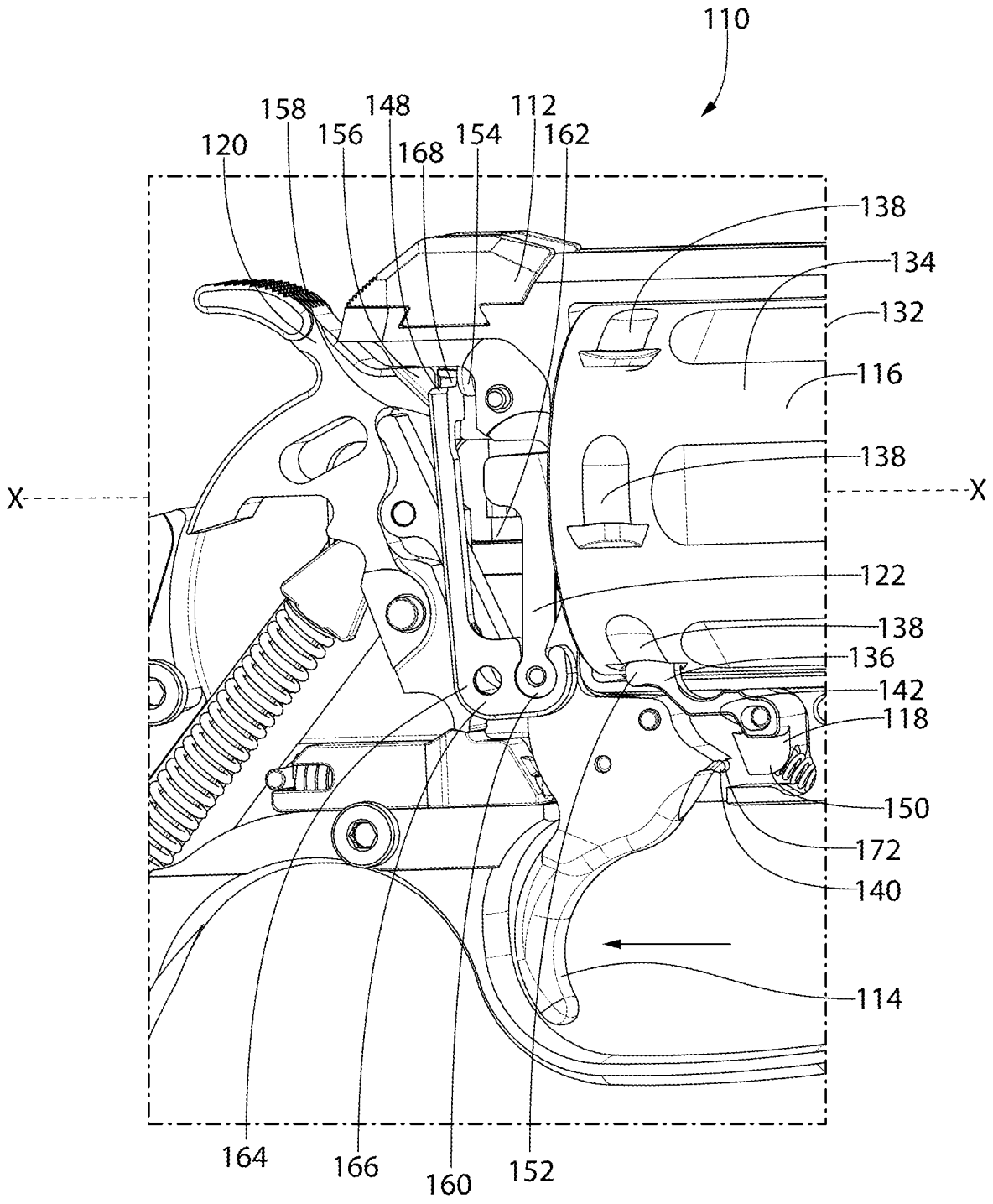
FIG. 12 is a partial right side isometric view of the apparatus to minimize short stroke in a revolver of FIG. 8, shown with its trigger in a fully depressed position.

For present purposes, a double action revolver is described, wherein depressing the trigger 114 both cocks the hammer 120 and rotates the cylinder 116 to align the next breach chamber 132 with the barrel 134. A firing cycle for the revolver is as follows. The firing cycle of the revolver 110 begins at a ready-to-fire configuration (see FIG. 11). As shown in FIG. 12, the trigger 114 is pulled, the bolt 118 disengages from the depression 138, the hand 122 engages the ratchet 126 to turn the cylinder 116 such that a new breach chamber 132 is aligned with the barrel 134, the bolt 118 engages a next depression 138 in the cylinder 116, a sear releases the hammer 120 to discharge a cartridge in the breach chamber 132 aligned with the barrel 134 and simultaneously, the transfer bar 164 raises such that its second end 168 is disposed between the hammer 120 and breach chamber 132 to allow for firing, and the trigger 114 is released causing the various elements to move back to the ready-to-fire configuration. The transfer bar 164 moves to a down position away from the firing pin. See FIG. 11. At the end of a firing cycle, the trigger 114 must be return to a fully undepressed condition (see FIG. 13) to allow the revolver 110 to be fired again.

As stated above, the revolver 110 of the present embodiment of the present invention includes the transfer bar 164; a common internal safety device seen on some revolvers. The transfer bar 164 must be in an "up" position between the hammer 120 to a frame mounted firing pin 154 (as well known). The transfer bar 164 is urged to its "up" (i.e., firing) position by a user placing pressure on the trigger 114. When pressure is removed from the trigger 114 by the user to undepress the trigger 114, the transfer bar 164 falls down and out of the way as the hammer 120 moves toward the firing pin 154 to discharge the firearm, but the user's finger is not on the trigger 114. As a result, the hammer 120 does not impart energy to the firing pin 154 such that the revolver 10 does not fire. This safety device prevents accidental discharge of the revolver 10 if the cocked hammer is inadvertently "jarred-off" when, for example, the revolver 10 is dropped. It also prevents accidental discharge if, for example, the revolver 10 is dropped and lands on its un-cocked hammer.

Figure 13:
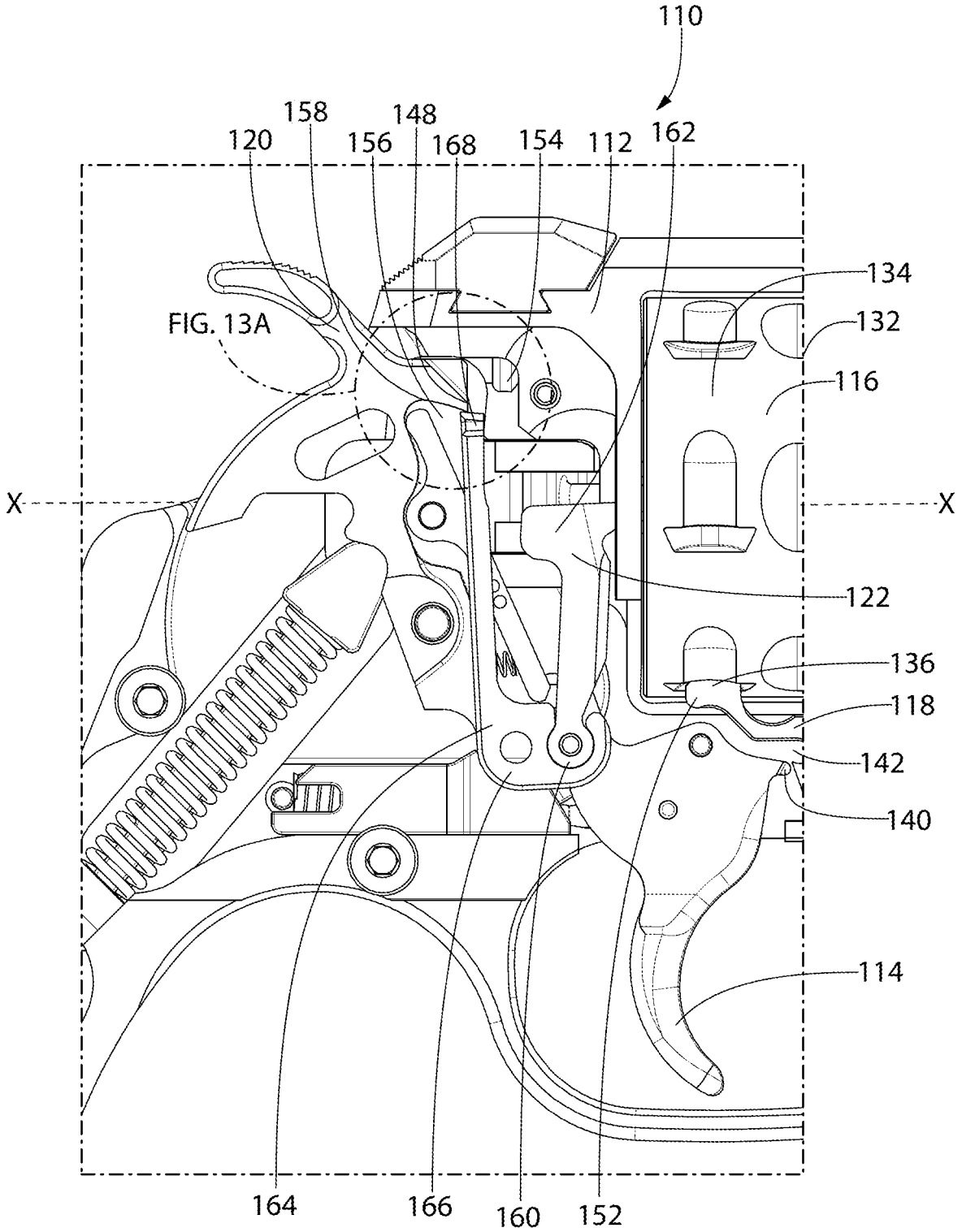
FIG. 13 is a partial right side elevation view of the apparatus to minimize short stroke in a revolver of FIG. 8, shown with its trigger in a position after discharge of the revolver, but before the trigger is fully undepressed, where short stroke would occur.
Figure 13A:
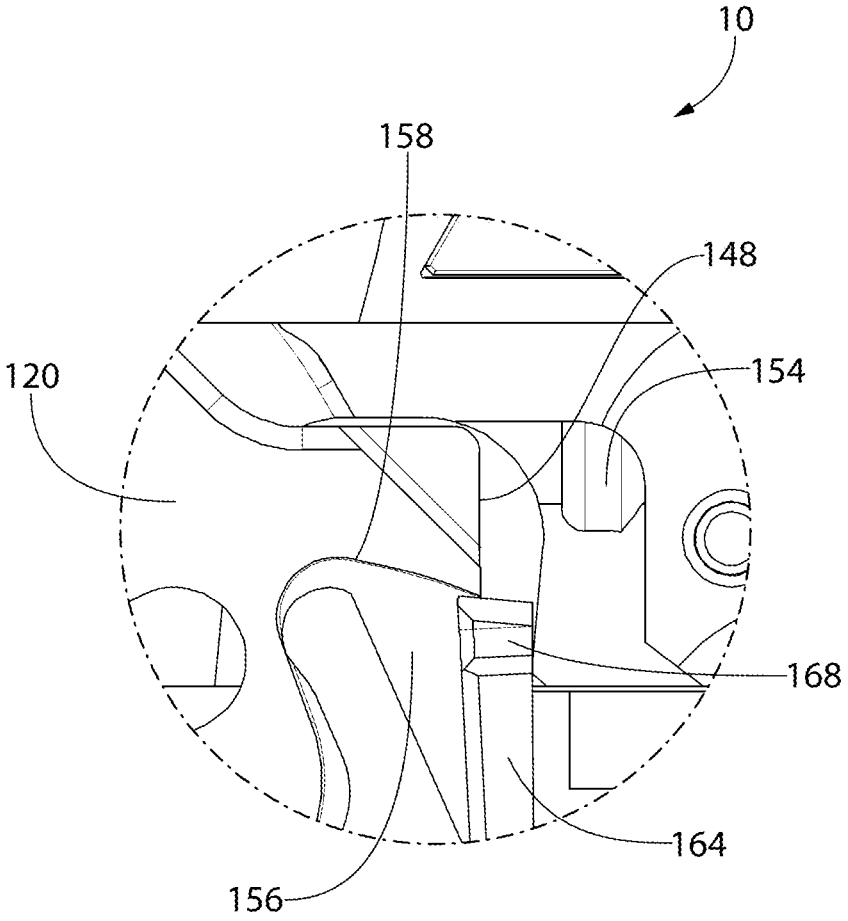
FIG. 13A is an enlarged, right side elevation detail view of the apparatus to minimize short stroke of FIG. 13, taken at Detail "FIG. 13A" of FIG. 13.
Figure 14A:
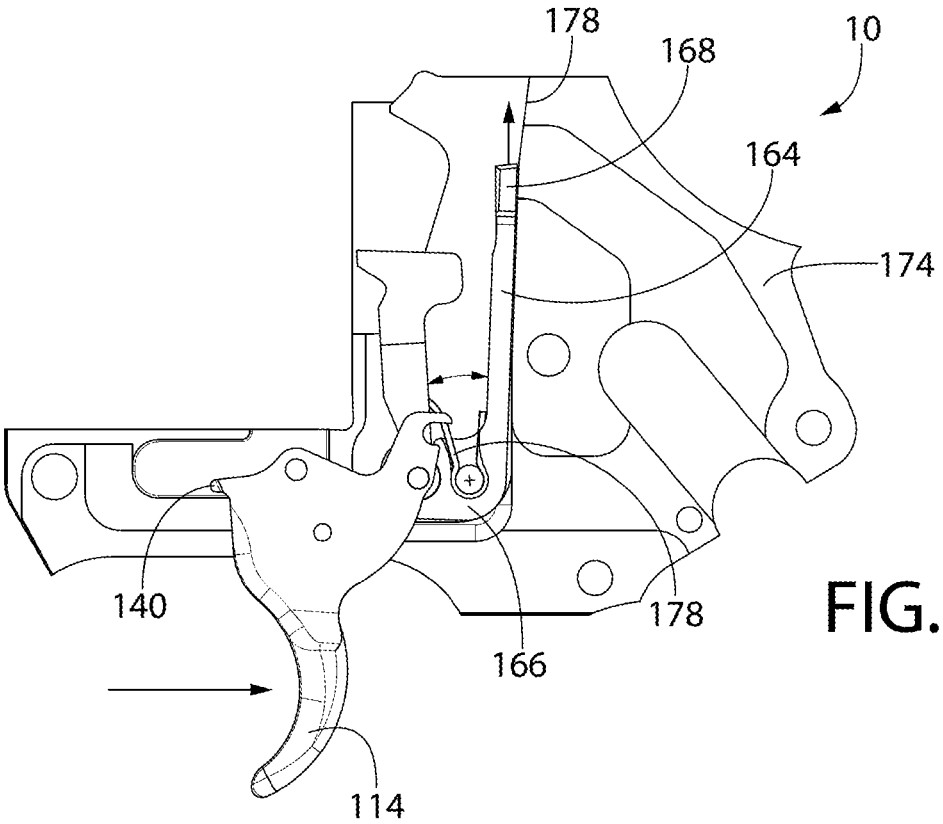
FIG. 14A is an enlarged, partial left hand side elevation view of the apparatus to minimize short stroke of FIG. 8, showing the trigger, transfer bar, transfer bar spring and sideplate and related elements, shown in a ready-to-fire position.
Figure 14B:
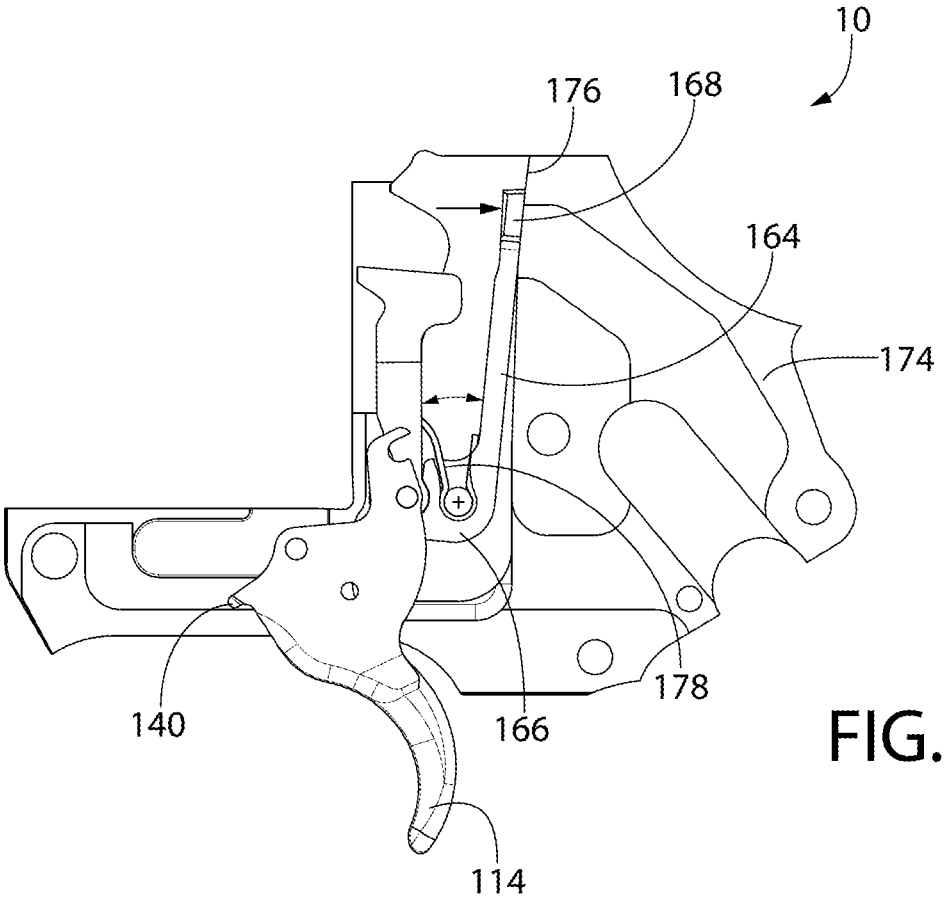
FIG. 14B is an enlarged, partial left hand side elevation view of the apparatus to minimize short stroke of FIG. 8, showing the trigger, transfer bar, transfer bar spring and sideplate and related elements, shown with the trigger fully depressed.

In accordance with the present invention, the hammer 120 has a hammer slot 156 therein, wherein the hammer slot 156 has a transfer bar blocking surface 158. The transfer bar 164 has a first end and a second end 168. The first end 166 of the transfer bar 164 is pivotably disposed on the trigger 114 adjacent to the first end 160 of the hand 122. The second end 168 of the transfer bar 164 is disposed adjacent to the hammer surface 148 (which may be the firing pin of a revolver not having a transfer bar) of the hammer 120. When the revolver 10 is in the ready-to-fire position (see FIG. 11), the second end 164 of the transfer bar 164 is disposed between the hammer 120 and the breach chamber to 132 enable a cartridge in the breach chamber 132 to be fired. Subsequent to firing and prior to the revolver 10 being reset, the trigger 114 cannot be depressed until the trigger 114 is first fully undepressed (see FIGS. 13 and 13A), wherein the second end 168 of the transfer bar 164 engages the transfer bar blocking surface 158 of the hammer slot 156 in the hammer 120 to prevent the trigger 114 from being fully depressed before the revolver 10 has reset. The rearward motion of the transfer bar 164 is controlled by a sideplate (see FIGS. 8, 14A and 14B) which has a cam surface 176 providing for the transfer bar 164 to be moved rearward, under the hammer 120 under the influence of a transfer bar spring 178. See FIG. 8.

Figure 15:
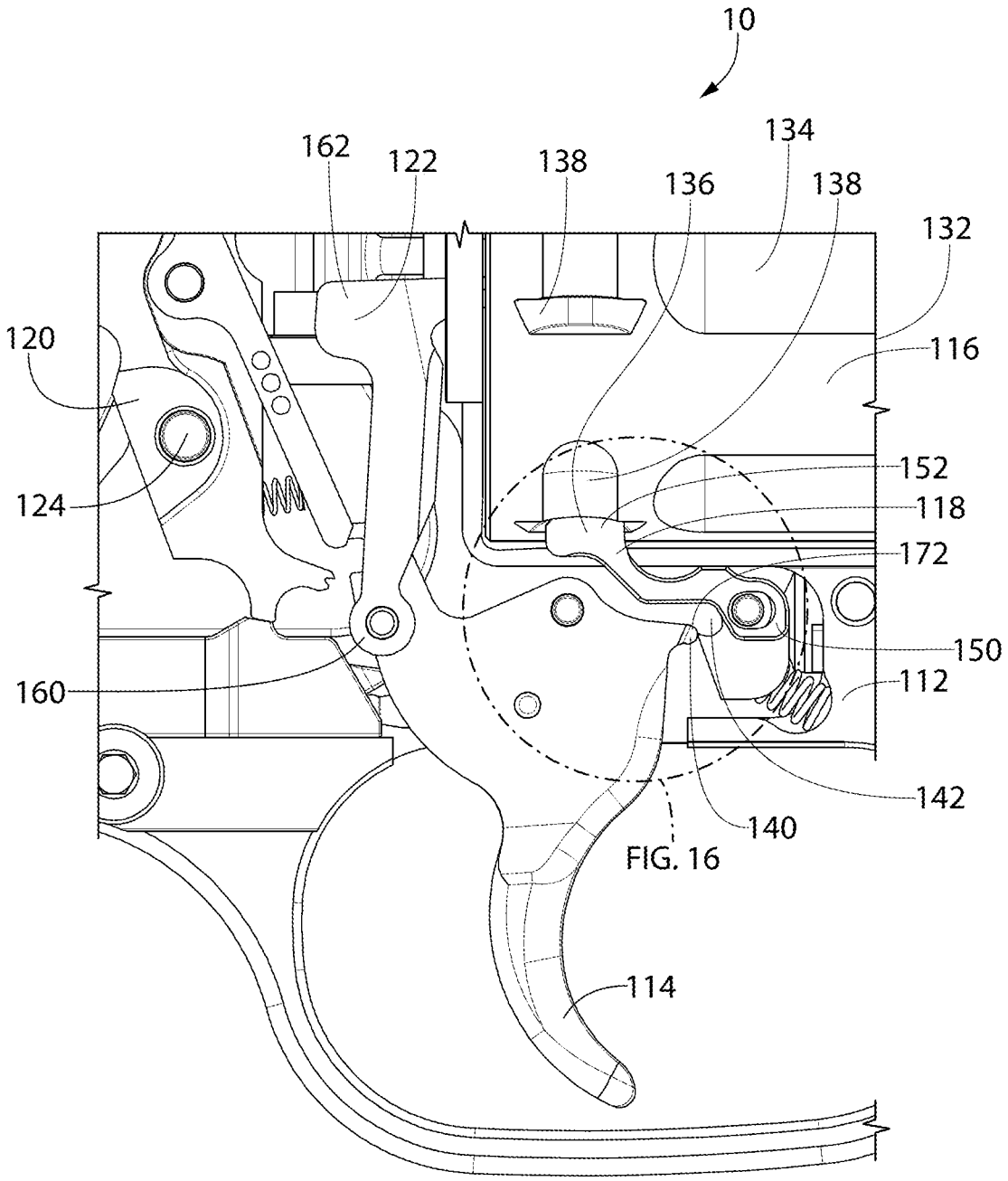
FIG. 15 is a partial, right side elevation view of an alternate or supplemental embodiment of an apparatus to minimize short stroke in a revolver, shown with its trigger in a position after discharge of the revolver, but before the trigger is fully undepressed, where short stroke would occur.
Figure 16:
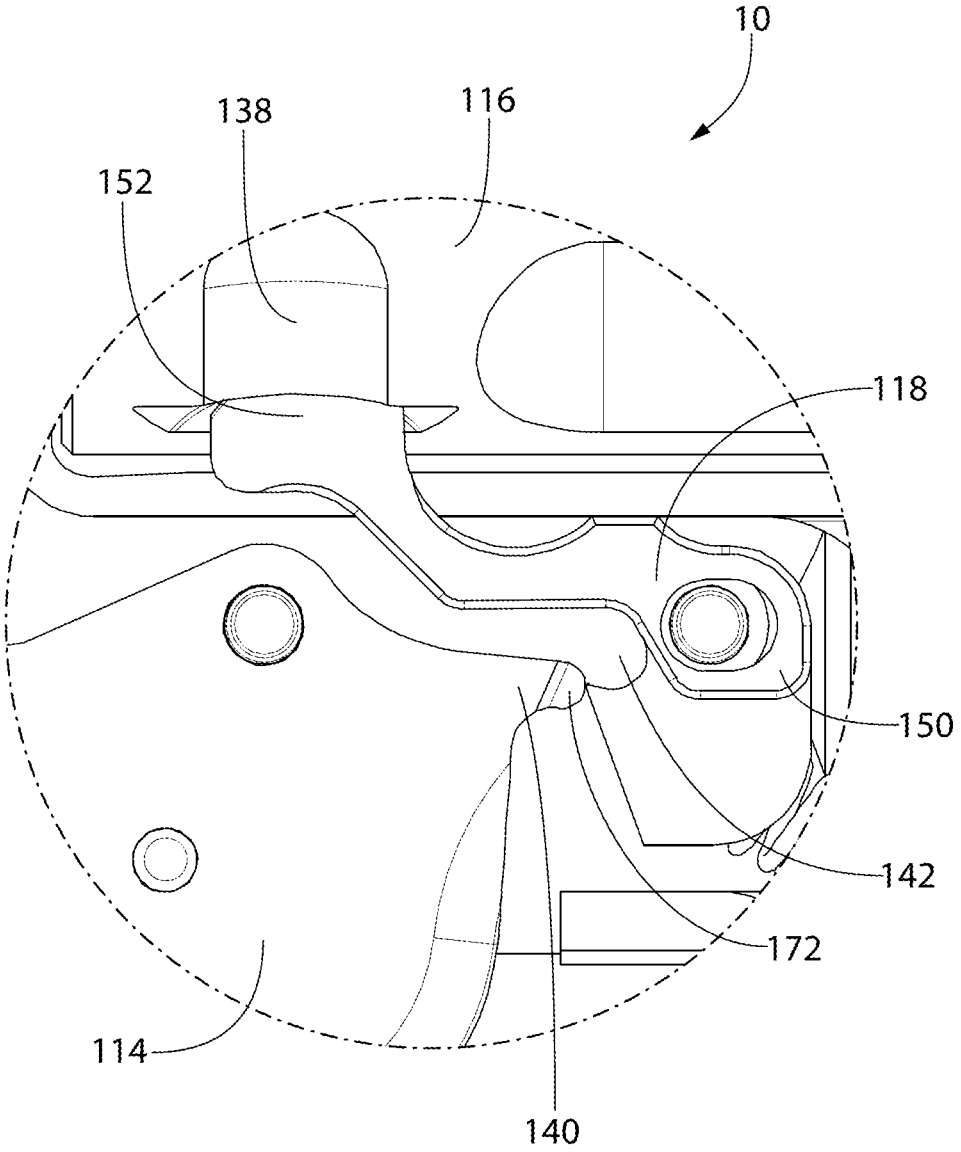
FIG. 16 is an enlarged, right side elevation detail view of the apparatus to minimize short stroke in a revolver of FIG. 15, shown at "FIG. 16" of FIG. 15.

In an alternate embodiment of the present invention to minimize short stroke in a revolver (that may or may not have a transfer bar), as seen in FIGS. 15-16, a second mechanical feature may be incorporated into the revolver 110. Here, the trigger pawl 140 has a rounded nose 142 such that the trigger 114 cannot pull the bolt 118 out of engagement and ensure that the bolt 118 is always properly reset. This feature is described in more detail below and, as stated, can serve as a stand-alone feature to minimize short stroke of the revolver 10.

As described above, the alternate apparatus to minimize short stroke in a revolver 110 is directed to the trigger pawl 140 having a rounded nose 172. Again, the revolver 110 has the frame 112, barrel 134, trigger (114 having the trigger pawl 140), a cylinder 116 disposed in the frame 112 having a plurality of breach chambers 132 disposed about the central axis X and a ratchet 126 having teeth 128. The cylinder 116 is adapted to rotate about the central axis X, and has a plurality of depressions 138 on the outer surface of the cylinder 116 where each depression 138 is disposed adjacent to one of the breach chambers 132. The ratchet 126 has the teeth 128 to index the cylinder 116 in the frame 112 to serially align one of the breach chambers 132 with the barrel 134. The revolver 110 also has a bolt 118 and a hand 122 as is common on most revolvers. The bolt 118 is pivotably disposed on the frame 112 between the trigger 114 and the cylinder 116, and has a first end 150 having a receiving slot 142 for receiving the trigger pawl 140 and a second end 152 having a bolt pawl 136 for engaging one of the depressions 138 in the cylinder 116. The hand 122 has a first end 160 disposed on the trigger 114 and a second end 162 disposed against a tooth 128 of the ratchet 126 wherein pulling (i.e., depressing) of the trigger 114 causes the hand 122 to index the cylinder 116 to align a new breach chamber 132 with the barrel 134 for discharging the revolver 110. The trigger pawl 140 has a rounded nose 172 (rather than a flat surface-reference number 44—of the prior art FIGS. 1-7) such that the trigger 114 cannot pull the bolt 118 out of engagement and ensure that the bolt 118 is always properly reset. The rounded nose 172 provides a camming surface rather than a flat surface to act on the receiving slot 142 of the bolt 118 such that short stroke does not occur.

While the invention has been described in detail and with reference to specific embodiments thereof, it will be apparent to one skilled in the art that various changes and modifications can be made therein without departing from the spirit and scope thereof.

What is claimed is:

1. An apparatus to minimize short stroke in a revolver, wherein pulling of a trigger of the revolver activates a hammer of the revolver to fire the revolver, the revolver having a ready-to-fire position wherein the trigger is in a fully undepressed configuration, wherein the revolver must be brought to the ready-to-fire position subsequent to each firing cycle of the revolver, the revolver comprising:

(a) a frame;

(b) the hammer rotationally mounted in the frame and having a firing pin and a pivot axis, the hammer having a hammer slot therein, the hammer having a first side and a second side wherein the pivot axis is disposed between the first side and the second side, the hammer slot being an inset area of the hammer having a hammer slot wall, said hammer slot wall disposed parallel to the first side and the second side, perpendicular to the pivot axis, and disposed between the first side and the second side, the hammer slot having a transfer bar blocking surface;

(c) a barrel;

(d) the trigger having a trigger pawl;

(e) a cylinder disposed in the frame having a plurality of breach chambers disposed about a central axis and a ratchet having teeth, said cylinder adapted to rotate about the central axis, said cylinder having a plurality of depressions, each depression disposed adjacent to one of said breach chambers, said ratchet having teeth to index the cylinder in the frame to align one of said breach chambers with said barrel;

(f) a bolt pivotably disposed on the frame between the trigger and the cylinder, the bolt having a first end having a receiving slot for receiving the trigger pawl, the bolt having a second end having a bolt pawl for engaging one of said depressions;

(g) a hand having a first end disposed on the trigger, and a second end disposed against a tooth of the ratchet, wherein pulling of the trigger causes the hand to index the cylinder to align a new breach chamber with the barrel;

(h) a transfer bar having a first end and a second end, the first end of the transfer bar pivotably disposed on the trigger adjacent to the first end of the hand, the second end of the transfer bar disposed adjacent to the firing pin of the hammer, the transfer bar having a first position when the revolver is in the ready-to-fire position and the second end of the transfer bar is disposed away from the hammer and the breach chamber to prevent a cartridge from being fired, the transfer bar having a second position at firing and the second end of the transfer bar moves between the hammer and the breach chamber to provide for discharging of the revolver, and, during the firing cycle, prior to the revolver being brought back to the ready-to-fire position, the trigger cannot be depressed until the trigger is first fully undepressed, and the second end of the transfer bar engages the transfer bar blocking surface of the hammer slot in the hammer to prevent the trigger from being fully depressed;

wherein the firing cycle of the revolver begins at the ready-to-fire configuration, the trigger is pulled, the bolt disengages from the depression, the hand engages the ratchet to turn the cylinder such that a new breach chamber is aligned with the barrel, the bolt engages a next depression in the cylinder, the hammer activates to discharge a cartridge in the breach chamber aligned with the barrel and simultaneously, the transfer bar raises such that its second end is disposed between the hammer and breach chamber to allow for firing, and the trigger is released causing the various elements to move back to the ready-to-fire configuration, wherein the transfer bar moves to a down position away from the firing pin.

2. The device to minimize short stroke in a revolver of claim 1, wherein the device comprises the trigger pawl having a rounded nose such that the trigger cannot pull the bolt out of engagement and ensure that the bolt is always properly reset.

* * * * *